US010499718B2

(12) United States Patent
Li

(10) Patent No.: US 10,499,718 B2
(45) Date of Patent: Dec. 10, 2019

(54) COOLER BAG WITH A DETACHABLE LINER AND LINER BASE

(71) Applicant: Richard Q Li, Ocala, FL (US)

(72) Inventor: Richard Q Li, Ocala, FL (US)

( * ) Notice: Subject to any disclaimer, the term of this patent is extended or adjusted under 35 U.S.C. 154(b) by 0 days.

(21) Appl. No.: 15/882,732

(22) Filed: Jan. 29, 2018

(65) Prior Publication Data

US 2018/0146758 A1 May 31, 2018

Related U.S. Application Data

(63) Continuation-in-part of application No. 13/682,735, filed on Nov. 21, 2012, now Pat. No. 9,938,068.

(51) Int. Cl.

| | |
|---|---|
| ***A45C 11/20*** | (2006.01) |
| ***A45C 13/02*** | (2006.01) |
| ***B65D 81/38*** | (2006.01) |
| *A45C 3/04* | (2006.01) |

(52) U.S. Cl.

CPC ..... *A45C 11/20* (2013.01); *A45C 13/02* (2013.01); *B65D 81/3893* (2013.01); *A45C 3/04* (2013.01); *A45C 2013/026* (2013.01)

(58) Field of Classification Search

CPC ..... A45C 3/08; A45C 3/04; A45C 7/0086; A45C 11/20; A45C 13/002; A41F 1/004; A41F 1/02

USPC ..... 383/4, 111; 220/495.01, 495.03, 495.06, 220/495.08, 495.1

See application file for complete search history.

(56) References Cited

U.S. PATENT DOCUMENTS

| | | | | |
|---|---|---|---|---|
| 747,192 | A * | 12/1903 | Lee | A41F 1/02 24/659 |
| 4,453,623 | A * | 6/1984 | Horii | A45C 13/02 190/102 |
| 9,480,315 | B2 * | 11/2016 | Goodale | A45C 3/08 |
| 2016/0100655 | A1 * | 4/2016 | Maussen | A44B 1/00 24/114.7 |
| 2018/0055164 | A1 * | 3/2018 | Echelman | A45C 13/08 |

* cited by examiner

*Primary Examiner* — Jes F Pascua
*Assistant Examiner* — Nina K Attel

(57) ABSTRACT

A cooler bag with a detachable liner and a liner base can be used as a carry bag when the liner is detached. The liner is attached to a base, which has short side walls at each end of the side of the base. The liner is folded up and placed in the base, which is then inverted to store the folded liner and serves as the base of the carry bag.

1 Claim, 5 Drawing Sheets

COOLER BAG WITH A DETACHABLE LINER AND LINER BASE

BACKGROUND OF INVENTION

The cooler bags we use nowadays have fixed liners. When liquid food or soup spills in the bag, the stitched seams of the liner are not waterproof and allow the liquid to soak all layers of the bag and in the meantime the water-impermeable liner material prevents thorough cleaning of the bag. The nutrient from the soup is absorbed by the spongy insulation layer, which creates a favorable medium for bacterial growth. In fact many people carry dirty-looking cooler bags with their lunch and supper in it.

As a cooler bag with fixed liner can't be cleaned, it will be discarded when it is dirty enough. So, it is considered a disposable item. As a disposable item, it is made with low-quality materials and craftsmanship.

I have designed a bag with a detachable liner. With the liner attached, it is a cooler bag. With liner detached, it is used as a usual carry bag. Such a bag with dual function of a cooler bag and a carry bag requires that the liner is waterproof without stitched seams to minimize the spoilage by spilled liquid food. In case of an extensive soup spill in the bag, the liner can be detached and the bag can be thoroughly cleaned and reused. A damaged liner can be easily replaced with a new one. A bag with dual function of cooler/carry bag can be expected to be a durable item instead of a disposable one and merits fine materials and craftsmanship and diverse design styles.

There are prior arts about removable bag liners, but they did not address the proper placement of the liner. The liner is either left outside the bag, which can be hard to find or be lost, or inside the bag, in which case the liner is exposed to the tear and wear by the items in the bag and also contributes to the mess in the bag.

SUMMARY OF INVENTION

This invention is continuation in part of and claims benefit of the application Ser. No. 13/682,735, cooler/lunch bag with detachable liner, and discloses a fastener to releasably attach a liner to a bag and a base for the liner. The liner has a row of +-shaped slits on its top margin, which correspond to a row of round studs on the top margin of the cooler bag. Each round stud is inserted into each +-shaped slit so as to attach the liner to the interior of the bag. As the items inside the liner may pull the liner downward, the upper slit of the +-shaped slit may also move downward and straddle the stem of the round stud. In regard to this scenario, the upper slit of the +-shaped slit is made wider than other three slits, but slightly narrowed than the stem of the round stud. Therefore, when the liner is pulled downward, the upper slit of the +-shaped slit also moves downward, straddles and squeezes the stem of round stub and creates a more stable engagement between the round stud and +-shaped slit than when the round stud is in the center of +-shaped slit. The strip with +-shaped slits and the strip with round studs can switch positions. It can also be substituted by zippers.

The bottom of the liner is attached to a stiff plastic base, which has side walls on both sides. The liner is not attached to the side walls. The shape of the base of the liner conforms to the shapes of the bottom of bags, which can be rectangular, oval, round and square. The side wall doesn't run the whole length of each side of the base and there is no side wall in the mid-section of the base. If a food container is wide than the width of the bottom of the bag (or wider than the width of base of the liner), it can sit flatly on the bottom of the bag in the middle part of the bag instead of sitting on the edge of the side walls.

The bag functions as a cooler bag when the liner is attached to the bag by the engagement of round studs in +-shaped slits. When the cooler bag is to be used as a usual carry bag, the liner can be easily detached from the bag by disengaging its +-shaped slits from the round studs on the bag, rolled up around the axis formed by its top margin and pressed into the base. Then the base, which now contains the folded liner, is inverted, so that its bottom surface functions as a bottom of the carry bag.

DETAILED DESCRIPTION OF THE INVENTION

Figure 1:
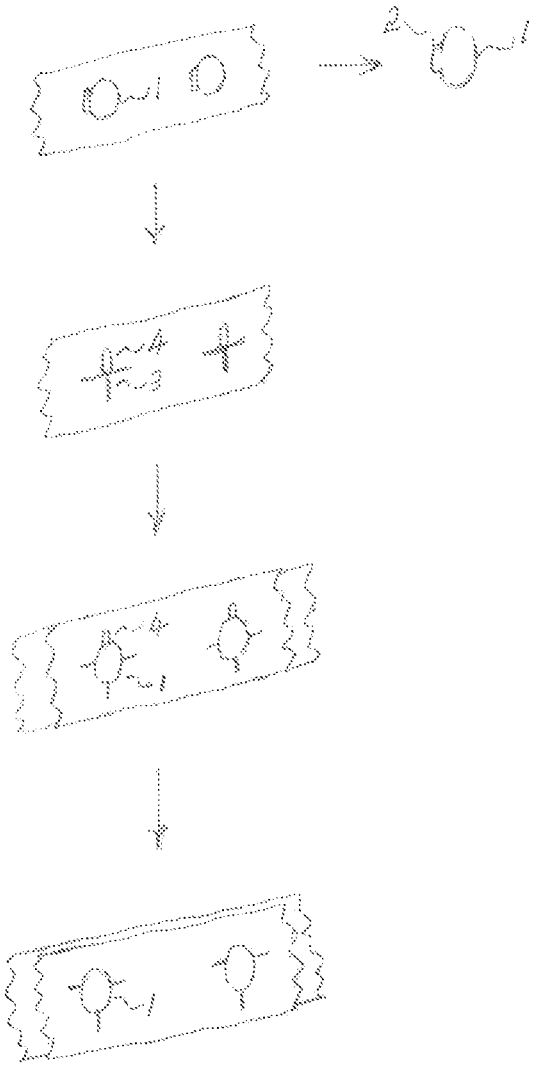
FIG. 1 demonstrates a plastic strip with a row of round studs (on the top margin of a bag) and a plastic strip with a row of +-shaped slits (on the top margin of a liner) or vice versa.

FIG. 1 demonstrates a thin plastic strip with a row of round studs 1, attached to the top margin of a bag; the round stud having a short stem 2; a thin plastic strip with a row of +-shaped slits 3, attached to the top margin of a liner. The upper slit 4 of the +-shaped slits 3 is wider than the other three slits. When the round stud 1 is inserted in the +-shaped slit 3, the two plastic strips are connected, so are the top margins of the liner and the bag. The +-shaped slit creates four flaps, which are resilient and grip the stem 2 of the round stud and keep the round stud 1 behind the +-shaped slits.

The stem 2 of each round stud is short enough to ensure tight junction of the top margins of the bag and of the liner and to eliminate a gap between the two margins so as to prevent food particles from falling into the space inbetween.

As gravity created by the items in the liner pouch pulls the liner downward, so is the +-shaped slits in the top margin of the liner. The upper slit 4 would shift downward and straddle the short and narrow stem 2 of the round stud. In regard to this scenario, the upper slit 4 is made wider than the other three slits, but is slightly narrower than the stem, such that when the upper slit straddle the stem, it squeezes it. In other words, the stem 2 is stuck in the upper slit 4, which is a more stable engagement than when the stem 2 is in the center of the +-shaped slit 3.

The fastener of round stud in the +-shaped slit can be substituted by zippers.

Figure 2:
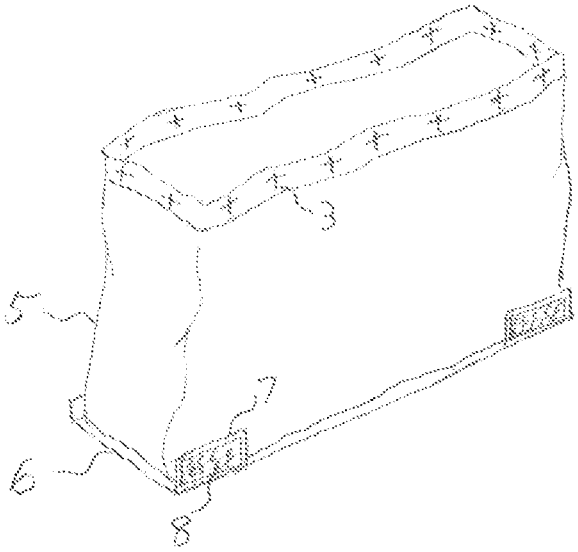
FIG. 2. demonstrates a liner attached to its base, but not attached to side walls. The middle section of the base has no side wall.

FIG. 2 demonstrates an opened liner 5 attached to its base 6, but not attached to side walls 7. The middle section of the base has no side wall. The liner is supposed to be waterproof.

The base is immobilized and attached to the interior of the bag by means of hook and loop patches 8 on its side walls.

Figure 3:
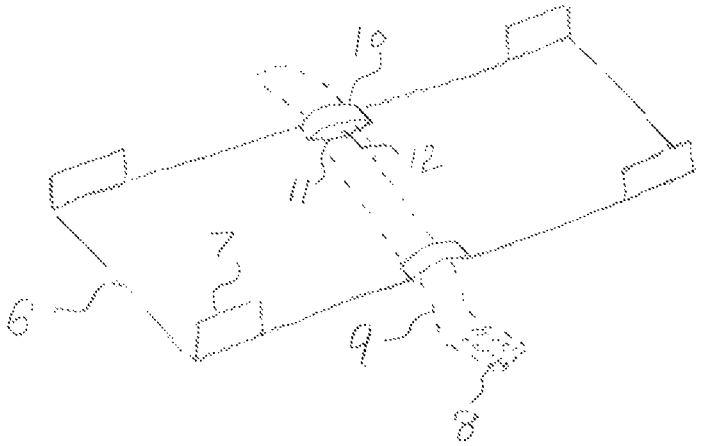
FIG. 3 demonstrates a rectangular or square base with side walls only at both ends of the longitudinal sides.

FIG. 3 demonstrates a rectangular or square base 6 with side walls 7 at both ends of the longitudinal sides and without side walls in the mid-section or at both narrow ends.

In case a food container is wide than the width of the bottom of the bag (or wider than the width of base of the liner), it can sit flatly on the bottom of the bag in the middle part of the bag instead of sitting on the edge of the side walls.

Figure 4:
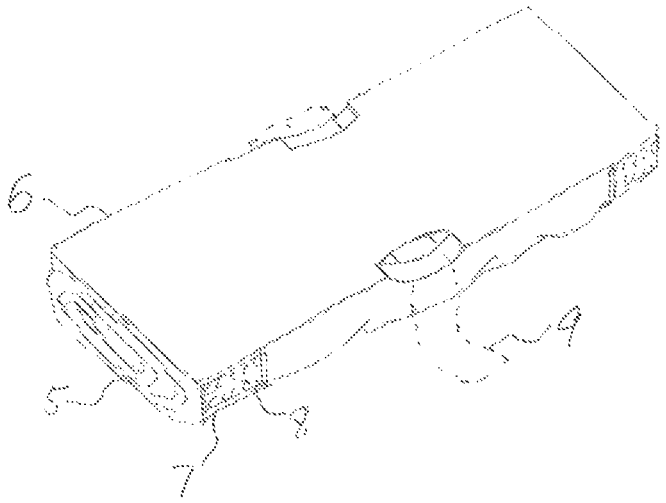
FIG. 4 demonstrates a detached, folded liner underneath the inverted base for storage.

As shown in FIG. 4, after the liner 5 is detached from the bag, it is folded and placed in the base 6. The base 6 is then inverted and inserted in the bottom of the carry bag. The folded liner 5 may open and fall out from the base while the inverted base with liner is being placed in the bottom of the carry bag. The folded liner in the base without side wall in the middle will definitely spread beyond the base. A strip 9 is needed to hold the folded liner in place. The strip 9 goes beneath the liner pouch and through a space on each side of midsection of the base 6.

As shown in FIG. 3, a small low-profile arch 10 arises from the edge of each midsection of the base 6, causing an indentation in the edge next to it in each midsection. The intended edge 11 of the midsection next to the small arch curves downward as much as the arch curves upward, creating a space 12, which allows the strip 9 to be threaded through. The space 12 between the low-profile arch 10 and the depressed indented edge 11 centers itself at the level of the base 6 instead of rising above from the base only, as an upright piece with an aperture would do, through which a strip could also be threaded through. The strip 9 closes itself with hook and loop patches 8 at each ends.

A space which centers itself at the level of the base has following advantages: its low profile causes minimal change in the flatness of either side of the base, either when it is upright or inverted; only a very small portion of the strip is visible at the edge when the base is inverted; it doesn't need additional process to glue it to the base.

FIG. 4 demonstrates a folded liner 5 underneath the inverted base 6. When the cooler bag is not in use, the liner 6 is detached by disengage the +-shaped slits 3 from the round studs 1. The liner 6 is rolled up around the axis formed by its top margin and packed in the base 6. The base 6 is then inverted, stores the folded liner 5 beneath it and is placed in the bottom of the carry bag. The bottom surface of the base is turned upward and serves as the base for the carry bag.

The base is immobilized and attached to the interior of the bag by means of hook and loop patches 8 on its side walls 7.

Figure 5:
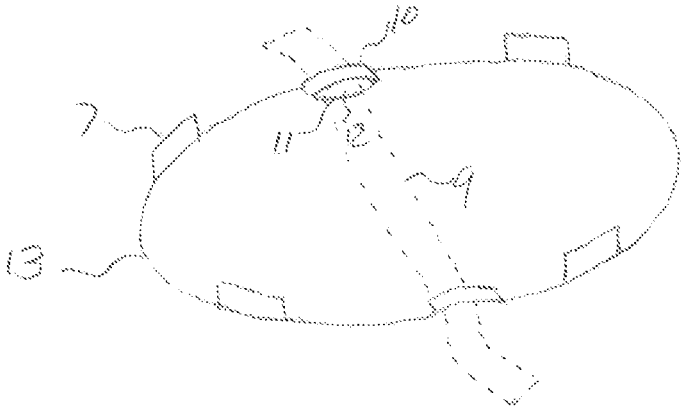
FIG. 5 demonstrates an oval or round base with side walls on both sides near the two opposing poles.

FIG. 5 demonstrates an oval or round base 13. It has side walls 7 on both sides near the two opposing poles and has no side walls in the midsection or at both poles. A small low-profile arch 10 arises from the edge of each midsection of the base and causes an indentation next to it in the edge of the base. The intended edge 11 of the base next to the small arch curves downward as much as the arch curves upward, creating a space 12, which allows the strip 9 to be threaded through. The strip closes itself with the hook and loop patches at each end.

What is claimed:

1. A cooler bag with a detachable liner and a liner base, wherein the detachable liner is waterproof and removably attached to the cooler bag by a plurality of fasteners comprising one of (a) a plurality of +-shaped slits on a plastic strip on a top margin of the detachable liner engaging a plurality of round studs on a plastic strip on a top margin of the cooler bag and (b) a zipper on the top margin of the detachable liner and the top margin of the cooler bag, wherein the liner base is made of a stiff plastic and has a side wall, wherein a small, low-profile arch arises from an edge of a midsection of the liner base and causes an indented edge next to it, wherein the indented edge curves downward creating a space, wherein a strip with hook and loop patches at each end is threaded beneath the detachable liner and through the space and closes itself with the hook and loop patches at each end, and wherein the detachable liner when detached and folded is held in place by the strip.

* * * * *